United States Patent [19]

Osako

[11] Patent Number: 4,621,757

[45] Date of Patent: Nov. 11, 1986

[54] SIGNATURE THICKNESS DISCRIMINATING APPARATUS

[75] Inventor: Tatsuo Osako, Urawa, Japan

[73] Assignee: K.K. Osako Seisakusho, Saitama, Japan

[21] Appl. No.: 736,534

[22] Filed: May 21, 1985

[30] Foreign Application Priority Data

May 29, 1984 [JP] Japan ..... 59-110381

[51] Int. Cl.[4] ..... B21J 15/28; B42C 13/04

[52] U.S. Cl. ..... 227/1; 227/3; 270/37; 270/56; 412/12

[58] Field of Search ..... 227/1, 3; 270/37, 53, 270/56; 412/12

[56] References Cited

U.S. PATENT DOCUMENTS

| | | | |
|---|---|---|---|
| 2,999,242 | 9/1961 | Young et al. | 227/1 |
| 3,191,925 | 6/1965 | McCain et al. | 227/1 X |
| 3,664,655 | 5/1972 | McCain et al. | 270/56 |
| 3,747,824 | 7/1973 | Linden | 270/37 |
| 4,132,402 | 1/1979 | Morrison et al. | 270/56 X |
| 4,429,795 | 2/1984 | Hawkes | 412/12 X |

FOREIGN PATENT DOCUMENTS

| | | | |
|---|---|---|---|
| 139656 | 1/1980 | German Democratic Rep. | 412/12 |

*Primary Examiner*—Paul A. Bell

*Attorney, Agent, or Firm*—Browdy and Neimark

[57] ABSTRACT

Apparatus for discriminating signature sets of abnormal total thickness from signature sets having normal total thickness in a saddle-wired preparing apparatus. The discriminating apparatus includes means for electrically detecting the movement of sensor wheels which are adapted to discriminate a signature set of normal thickness from one having abnormal thickness, means for timing the output of this detected signature through a mechanical detector, and solenoid means for switching a stitcher and a deflector lever.

2 Claims, 10 Drawing Figures

SIGNATURE THICKNESS DISCRIMINATING APPARATUS

BACKGROUND OF THE INVENTION

This invention relates to a mechanism for discriminating signature sets of abnormal total thickness from those of normal total thickness in a saddle wired bookbinding apparatus. An apparatus for saddlewired bookbinding is generally adapted to supply signatures from a plurality of signature feeders so that the signatures are stacked on a transfer saddle; transfer the resultant signatures to a stitcher i.e. signature sets, with pushers is provided on gathering chains moving along the saddle; stitch the backs of the signature sets to provide saddle-wired sets; and feed the saddle-wired sets to a three-sided trimming unit and there cut off the upper, lower and fore marginal portions thereof, whereby finished saddle-wired signatures are prepared.

An unnecessary signature is often supplied from a signature feeder, or a required signature is not supplied from a signature feeder. If an unnecessary signature is sent to the transfer saddle, the total thickness of the resultant signature set becomes larger than a predetermined total thickness thereof. If a necessary signature is not sent to the transfer saddle, more precisely, a necessary signature fails to be taken, the total thickness of the resultant signature set becomes smaller than a predetermined total thickness thereof. If such a signature set with an unnecessary signature included therein, or with a neccessary signature omitted is wired in that condition an inferior book results. Namely, unless such a signature set having an extra signature or lacking one or more signatures is removed before it has been stitched to the outside of the system of a regular flow of signature sets, an inferior saddlewired book is put on the market.

In a conventional apparatus for saddle-wired bookbinding, these problems are solved in the following manner. Namely, a signature set, which consists of a predetermined number of signatures supplied from signature feeders, and which is sent to a stitcher, is passed between a vertically-movable sensor wheel provided at the upper side of the stitcher and a lower sensor wheel opposed to the movable sensor wheel, to detect mechanically the movement of the upper sensor wheel, which moves as it turns upward simultaneously with the passage of the signature set between the sensor wheels, amplify this movement mechanically, set the stitcher so that a stitch arm thereof is not operated in certain cases, that is, in such a manner that a signature set having an abnormal total thickness is not stitched, and switch a deflector lever mechanically for introducing the signature set of an abnormal thickness from a passage, which leads to a three-side trimming unit, to the outside of the system and laying it on the similar signature sets already discharged from the regular passage.

In order to amplify a small quantity of movement of the sensor wheel mechanically, stop the movement of the stitch arm of the stitcher and switch the deflector lever in the above-described manner, it is necessary that the apparatus for saddle-wired bookbinding be formed in a very complicated construction. Namely, in order to carry out the above-mentioned operations, it is necessary to amplify and transmit the movement of the sensor wheel by driving various means, such as a lever, a rod and a crank. Moreover, it is extremely difficult and requires parts of a very complicated construction to time mechanically the actions of a stitcher operating means and a means for supplying a signature set to the three-side trimming unit since these means are disposed in different positions. In such an arrangement, breakage and wear of the parts of these means adversely affect the judment of the total thickness of a signature set. Therefore, judging of the total thickness of a signature set cannot be performed accurately.

SUMMARY OF THE INVENTION

The present invention has been developed in view of these facts. It is an object of the present invention to provide a mechanism for discriminating signature sets of abnormal total thickness from signature sets of normal total thickness in a saddle-wired preparing apparatus, having simple and rational means, i.e. a means for electrically detecting the movement of sensor wheels which are adapted to discriminate a signature set of an abnormal total thickness from a signature set of a normal total thickness, a means for timing the output of this detected signal through a mechanical detector, and a solenoid means for switching a stitcher and a deflector lever; and capable of solving the problems of the prior art mechanism of this kind and accurately discriminating a signature set of an abnormal total thickness from a signature set of normal total thickness without causing any mechanical troubles.

The above and other objects as well as advantageous features of the invention will become apparent from the following description of the preferred embodiment taken in conjunction with the accompanying drawings.

DESCRIPTION OF THE PREFERRED EMBODIMENT

Figure 1:
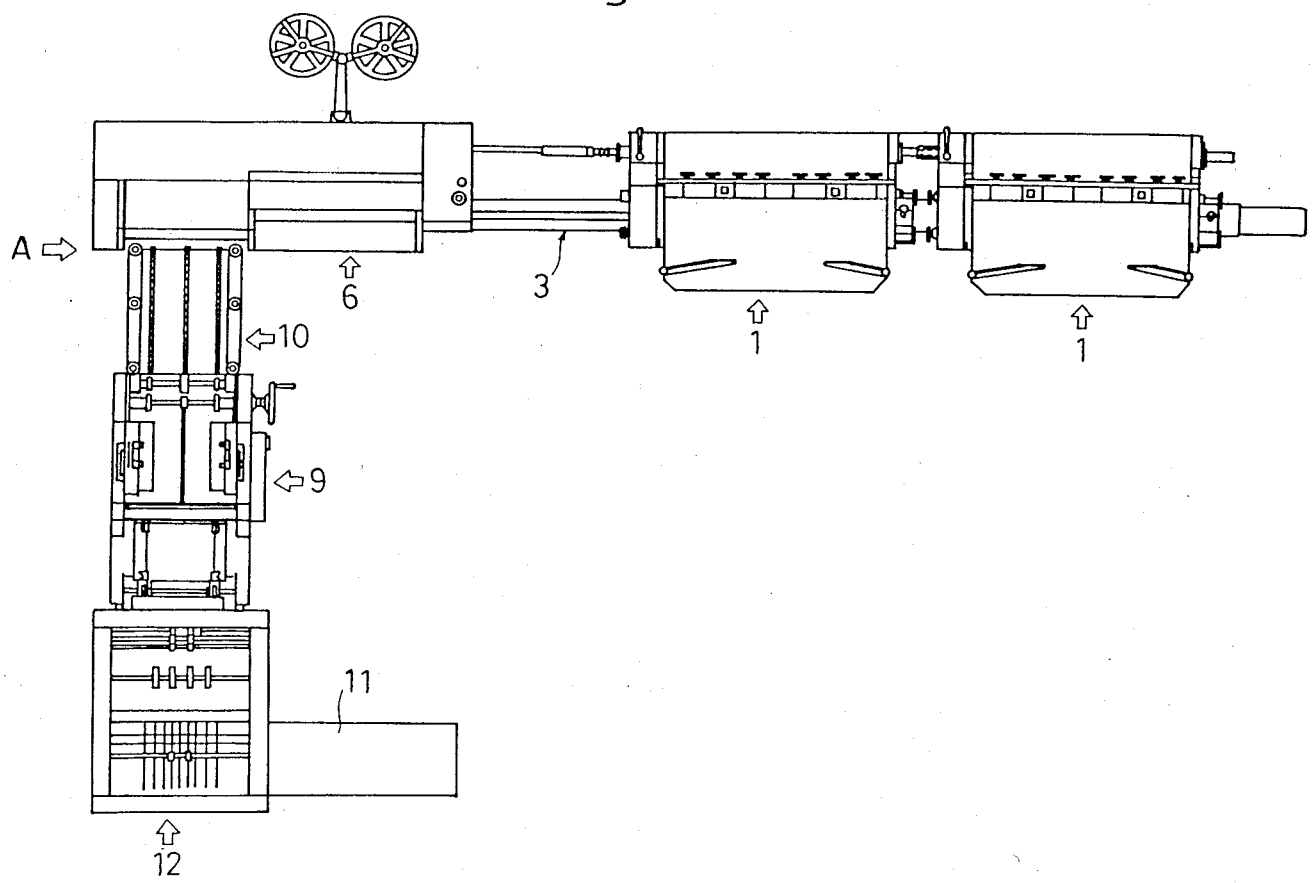
FIG. 1 is a plan view in schematic representation of a saddle-wired preparing apparatus.

A in the diagram denotes an apparatus for saddle-wired binding, which consists as shown in FIG. 1 of a plurality of signature feeders 1, a means 3 for transferring a signature 2 under the signature feeders 1 from the right side to the left side in this figure, a stitcher 6 provided at its upstream side with upper and lower sensor wheels 4, 5 for measuring the thickness of a signature set, a change-over means 8 provided with a deflector lever 7 which is adapted to be operated in accordance with the result of the judment of normality of a total thickness of a signature set, a means 10 for transferring a stitched signature set the total thickness of which has been judged to be normal to a three-side trimming unit 9, and a stacker 12 for piling saddle-wired bindings, the upper, lower and fore marginal portions of each of which have been trimmed, so as to form a plurality of groups of piled saddle-wired bindings, each of which groups consists of a predetermined number of saddle-wired bindings, and send the resultant saddle-wired bindings to a product-handling table 11.

The above signature feeders 1, transfer means 3, stitcher 6, change-over means 8, a three-side trimming unit 9, transfer means 10 and stacker 12 are constructed in a generally-known manner, and special detailed illustrations thereof will be omitted. The construction of the parts which are concerned with the present invention will be described in detail in order.

Figure 2:
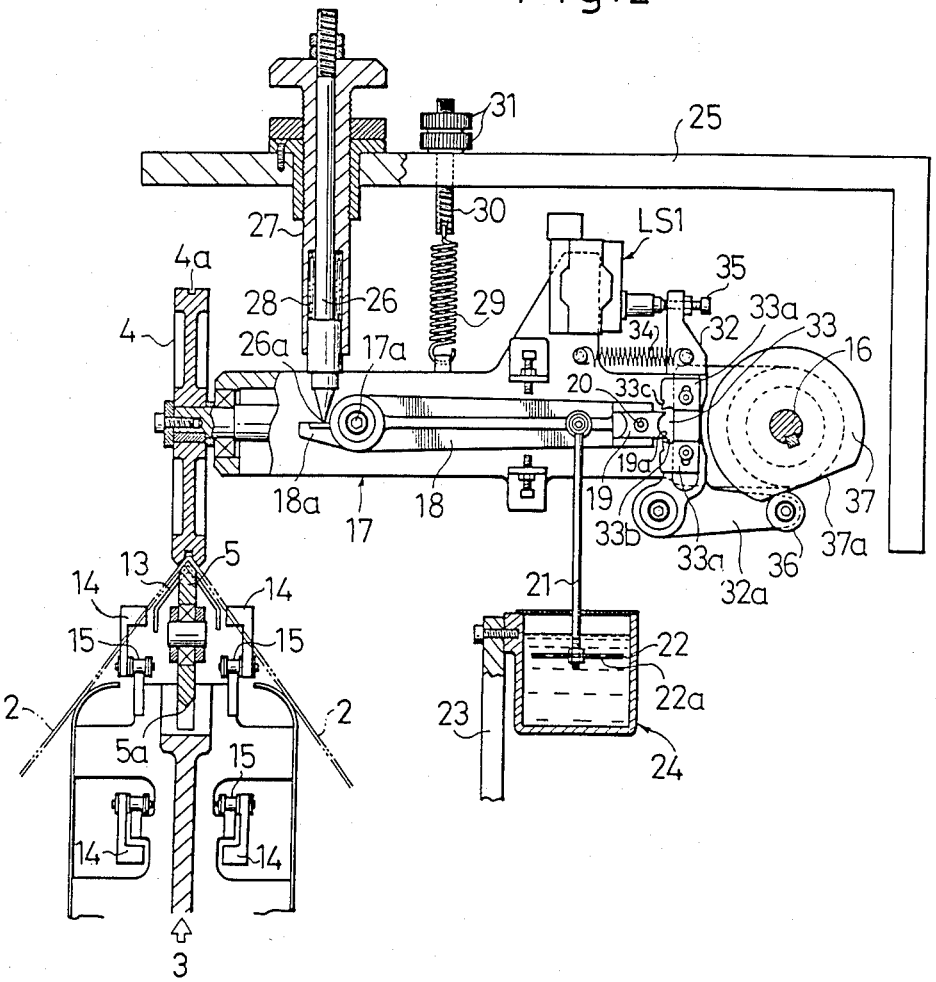
FIG. 2 is a partially-sectioned front elevation of a means for detecting a total thickness of a signature set.
Figure 3:
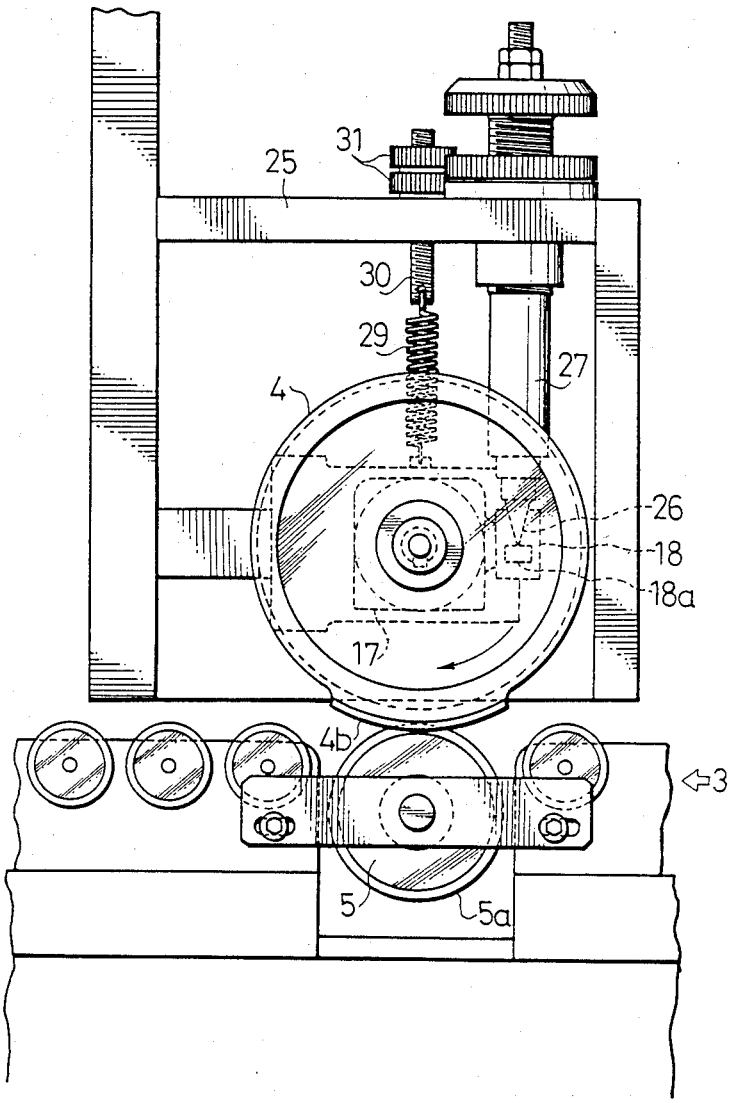
FIG. 3 is a side elevation of what is shown in FIG. 2.
Figure 4:
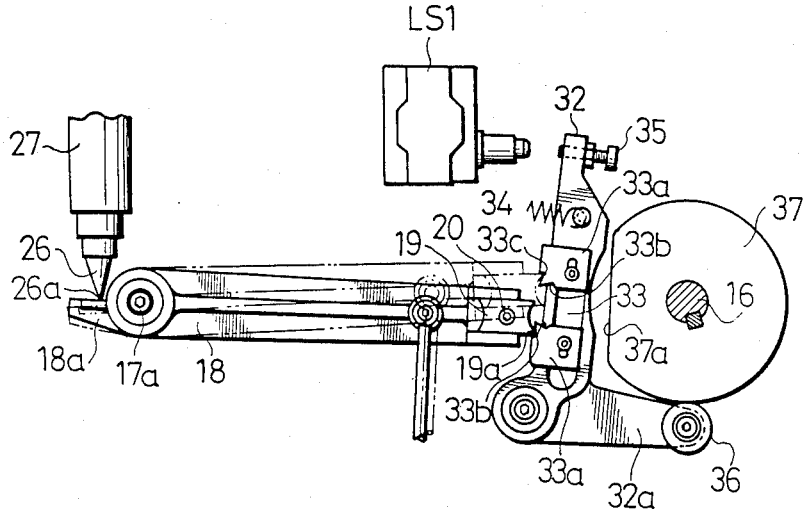
FIG. 4 is a front elevation of a principal portion of the thickness-detecting means of FIG. 2.

First, an arrangement for judging whether a signature set has a predetermined total thickness, in more detail, an arrangement for judging whether any unnecessary signature is taken in the signature set, or whether any necessary signature is not taken into the signature set will be described with reference to FIGS. 2–4. FIG. 2 shows the transfer means 3 for signatures. This transfer means 3 consists of a saddle 13 on which a signature 2 supplied from each of the signature feeders 1 is mounted in a separated state, and left and right gathering chains 15 provided with pushers 14 which are used to transfer the signature 2 on the saddle 13 and spaced at suitable intervals. The upper and lower sensor wheels 4, 5 are provided at the upstream side of the stitcher 6. The diameter of the lower sensor wheel 5 is smaller than that of the upper sensor wheel 4. The lower sensor wheel 5 is supported rotatably on a machine frame (not shown) which is positioned halfway between the left and right gathering chains 15 and used to attach these gathering chains 15 to the transfer means 3. This smaller-diameter sensor wheel 5 is positioned so as to contact the inner surface of the fold of a signature being transferred, and the side surfaces of this sensor wheel 5 extend in the moving direction of the gathering chains 15. The side surfaces of the upper sensor wheel 4 also extend in this direction. The upper larger-diameter sensor wheel 4 is provided on its outer circumferential surface with an annular groove 4*a*, to which an edge portion 5*a* formed on the outer circumferential surface of the lowrr sensor wheel 5 is opposed. Owing to the locking force of the edge portion 5*a* with respect to the groove 4*a*, a signature set passing through a narrow space between the sensor wheels 4, 5 is held securely to prevent the signature set from slipping, and thereby preventing the signature set transfer rate from varying. As is clear from FIG. 3, the upper sensor wheel 4 is provided with an increased diameter measuring portion 4*b* the length of which is about 1/6 of the circumferential length of the same sensor wheel 4. The substantial total thickness of a signature set is measured with this diameter-increased measuring portion 4*b* and the lower sensor wheel 5. The reason for this increased diameter portion 4*b* resides in the following. It is unnecessary to use the whole circumferential portion of each of the two sensor wheels 4, 5, especially, the upper sensor wheel 4 for measuring the total thickness of a signature set. If high pressure is applied from the whole circumferential portion to a signature set, a deep impression is left in some cases in the outer surface of the fold portion of the signature set. Providing the increased diameter measuring portion 4b is also based on the necessity of preventing the occurrence of such a deep impression.

As shown in FIG. 2, the upper sensor wheel 4 is mounted rotatably on a free end of an arm 17 which is connected pivotably to a rotary shaft 16 joined at its one end to the machine frame (not shown). The arm 17 is disposed so that the longer axis thereof extends at right angles to the signature set transferring direction of the gathering chains 15. A lever 18 extending in the lengthwise direction of the arm 17 is supported pivotably at its one end on one side surface of the arm 17 via a shaft 17*a*, and provided with a short locking member 18*a* which is formed integrally with the lever 18, and which is closer to the sensor wheel 4 than the shaft 17*a* on which the lever 18 is pivotably supported. The lever 18 is provided at its free end with an operating rod 19 having an arcuate recess 19*a* at a free end thereof. This operating rod 19 is secured to the lever 18 so that the operating rod can be moved to left and right by an adjusting screw 20.

A connecting rod 21 is joined pivotably at its upper end to the portion of the lever 18 which is close to the free end thereof, i.e. the portion of the lever 18 which is far away from the shaft on which the lever 18 is pivotably supported. A disc 22 provided with through bores 22*a* is secured to the lower end portion of this connecting rod 21, and inserted in an oil tank 24 provided on a support member 23 to thereby form a shock absorber system. A pointed lower end portion 26*a* of a rod 26 for setting the total thickness of a signature set, which rod 26*a* is fixed to a hook-shaped support member 25 so that the rod 26*a* can be vertically regulated, is engaged with the upper surface of the locking member 18*a* formed at the portion of the lever 18 which is on the side of the sensor wheel 4. This thickness setting rod 26 is inserted through a regulator rod 27 which is screwed to the hook-shaped support member 25. A spiral spring 28 is provided between the thickness setting rod 26 and regulator rod 27 so that the thickness setting rod 26 can be moved up a little within the regulator rod 27 against the resilient force of the spiral spring 28. A spiral spring 29, which urges the arm 17 so as to turn the same upward about the rotary shaft 16, is provided between an intermediate portion of the arm 17 and the hook-shaped support member 25. This spiral spring is connected at its upper end to the lower end of an adjust screw rod 30 which is inserted vertically through the hook-shaped support member 25. A double nut 31 contacting the upper surface of the hook-shaped member 25 engages the upper portion of this adjusting screw rod 30. The resilient force of the spiral spring 29 is regulated by the double nut 31 and adjusting screw rod 30. The arm 17, which is urged by the spiral spring 29 so as to be turned upward is stopped in a balanced manner by the thickness setting rod 26, which is in press contact with the upper surface of the locking member 18*a*, and the resilient force of the spiral spring 28. Reference numeral 32 denotes a dog lever connected pivotably at its lower end to a lower side of the base end portion of the arm 17. The dog lever 32 is provided at its intermediate portion with a dog 33 with which the free end of the operating rod 19, which is provided at the free end of the lever 18 extending along the arm 17, engages. This dog 33 is formed between upper and lower dog member 33*a* which are fixed to the dog lever 32 so that the dog members 33*a* can be regulated vertically. The width of the dog 33 is regulated by moving the dog members 33*a* in the vertical direction. Notches 33*b* for guiding the angular ends, which are formed at the upper and lower sides of the operating rod 19, to the dog 33, and notches 33*c* for engaging the free end of the operating rod 19 with one of the upper and lower dog members 33*a* are formed in the opposite sides, which are opposed to the operating rod 19, and which define angular corner portions opposed to the operating rod 19, of the dog members 33*a*. It is when the total thickness of a signature set is within the range of a set level thereof that the operating rod 19 engages the dog 33. In the case where the free end of the operating rod 19 engages the upper or lower dog 33*a* to prevent the operating rod 19 from engaging the dog 33, the total thickness of a signature set is larger or smaller than a predetermined thickness thereof.

A spiral spring 34 is provided between the upper portion of the dog lever 32 and arm 17 so as to urge the dog lever 32 in such a manner that the dog lever 32 is turned toward the operating rod 19. A threaded knocker rod 354, in which the quantity of the front portion thereof which projects toward the sensor wheels 4, 5 can be regulated, is engaged with an upper end portion of the dog lever 32. A contact of a limit switch LS1 provided on the arm 17 is adapted to be switched from the ON-state to the OFF-state by the front end of this knocker rod 35. The contact of this limit switch LS1 is in the ON-state while the measurement is not being done. A lever 32*a*, which extends at substantially right angles to the lengthwise direction of the dog lever 32, is fixed at its one end to the lower end of the dog lever 32, and a small-diameter roller 36 is supported rotatably on the other end of the lever 32*a*. This roller 36 is engaged with the outer circumferential surface of a cam wheel 37 mounted on the rotary shaft 16 on which the lever 17 is pivotably supported. This cam wheel 37 consists of a flat cam surface 37*a* parallel to a tangential line of the cam wheel 37, and a neutral surface 37*b* concentric with the rotary shaft 16. When the roller 36 provided on the lever 32*a* has dropped onto the cam surface 37*a*, the dog lever 32 is turned toward the sensor wheels owing to the resilient force of the spiral spring 34. When the roller 36 is on the neutral surface 37*b*, the dog lever 32 is turned to the opposite side of the sensor wheels against the resilient force of the spiral spring 34. When a signature set moves through a narrow space between the sensor wheels 4, 5, the roll 36 is on the cam surface 37*a*, and the dog lever 32 is urged so as to be turned toward the sensor wheels. The operations of parts of the thickness judging system are timed in this manner.

A means for electrically processing a signature set discriminating signal will be described with reference to FIG. 5. This signal processing means constitutes the most important portion of the present invention. The signal processing means can be set on an arbitrary portion of a saddle-wired apparatus body. Reference numeral 38 denotes a base plate, which can be attached to an arbitrary portion, i.e. any portion, to which power can be transmitted, of a structure, which constitutes an apparatus for saddle-wired binding as mentioned above.

Reference numeral 39 denotes a rotary shaft fixed to the base plate 38 and adapted to be rotated in the direction an arrow with the number of revolutions per minute of ½ of that of the sensor wheels 4, 5. A large-diameter operating wheel 40 is mounted on the rotary shaft 39. Pins 41*a*, 41*b* which can project from the opposite surfaces of the operating wheel 40 are inserted in the bores 42 made in symmetrical portions in a peripheral section of this operating wheel 40, i.e., in the portions therein which are spaced at 180°. As shown in FIG. 5, each of these pins 41*a*, 41*b* is formed spherically at both ends thereof, and provided with two-grooves 43*a*, 43*b* in an intermediate portion of the outer circumferential surface thereof. A lock ball 44 adapted to engage with either of these grooves 43*a*, 43*b* is inserted in a bore 45 which is provided in the outer circumferential surface of the operating wheel 40. This lock ball 44 is urged constantly toward the pin 41*a* (41*b*) by a spring 46. As shown in this figure, when the lock ball 44 is engaged with either of the two grooves, one end portion of the pin 41*a* (41*b*) projects from one side surface of the operating wheel 40, and the other end portion thereof does not project from the other side surface of the same wheel 40.

The base plate 38 is provided thereon with a solenoid SOL1 which is adapted to be excited when a contact of the limit switch LS1 is on; a normally-opened limit switch LS2, which will be described later, is off; a normally-opened limit switch LS4 is on; and a contact of a relay CR11 is on. A roller 47 provided on an operating core (not shown) of the solenoid SOL1 is adapted to press the pin 41*a*, which projects to right in the drawing from the operating wheel 40, to left therein, so that the pin 41*a* projects to left from the same wheel 40. Consequently, the pin 41*a*, which projects to left in the drawing, engages a contact roller 48 of a normally-closed limit switch LS3 provided on the base plate 38, to turn off the contact thereof. Reference numeral 49 denotes a reset roller provided on the base plate 38 so as to be opposed to the path of the pivotal movement of the pins 41*a*, 41*b*. The reset roller 49 is adapted to press the pin 41*a* or 41*b*, which projects to left from the operating wheel 40, when the roller 49 passes the same pin, so that the pin 41*a* or 41*b* is projected to right from the operating wheel 40 to be thereby reset.

Reference numeral 50 denotes a cam wheel mounted on the rotary shaft 39. The cam wheel 50 is provided with projecting cam portions 51 on the portions of the outer circumferential surface thereof which are spaced at 180°, i.e. on the symmetrical portions of the mentioned surface. A normally-opened limit switch LS2 is provided on the base plate 38 so that the limit switch LS2 is opposed to the cam wheel 50, with a contact roller 52 of this switch LS2 provided near the outer circumferential surface of the cam wheel 50. While the cam wheel 50 makes one full turn, the contact roller 52 is operated twice by the cam portions 51 provided on the cam wheel 50, to turn on the contact of the limit switch LS2, Thus, when the contact of the limit switch LS1 is turned off, the contact of the limit switch LS2 is turned on at once. Even when the limit switch LS1 is not operated, i.e., even when the limit switch LS1 is in an ON-state, the limit switch LS2 is, of course, turned on and off repeatedly.

Reference numeral 53 denotes another cam wheel mounted on the rotary shaft 39. The cam wheel 53 is provided with projecting cam portions 54 on the portions of the outer circumferential surface thereof which are spaced at 180°, i.e. on the symmetrical portions of the mentioned surface. A limit switch LS4 the contact of which is normally opened is provided on the base plate 38 so that the limit switch LS4 is opposed to this cam wheel 53. A contact roller 55 of this limit switch LS4 is provided near the outer circumferential surface of the cam wheel 53. While the cam wheel 53 makes one full turn, the contact roller 55 is operated twice by the cam portions 54 provided on the cam wheel 53, to turn on the contact of the limit switch LS4. Thus, when the contact of the limit switch LS3 is turned off, the contact of the limit switch LS4 is turned on at once. Even when the limit switch LS3 is not operated, i.e., even when the limit switch LS3 is in an ON-state, the limit switch LS4, is, of course, turned on and off repeatedly.

Figure 5:
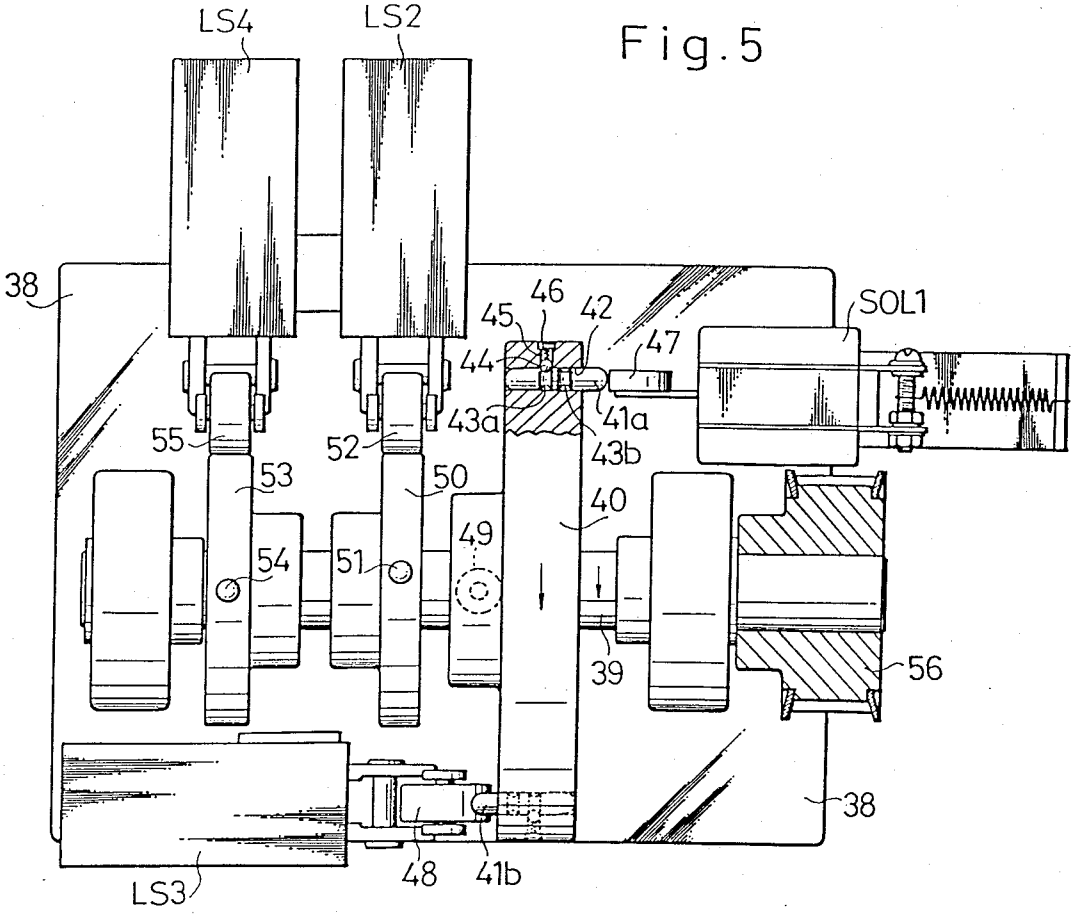
FIG. 5 is a front elevation of a means for electrically processing a signal for discriminating a signature set of an abnormal total thickness from a signature set of normal total thickness.

Reference numeral 56 in FIG. 5 denotes a driving wheel around which a chain for turning the rotary shaft 39 (not shown) in the direction of an arrow is wrapped.

Figure 6:
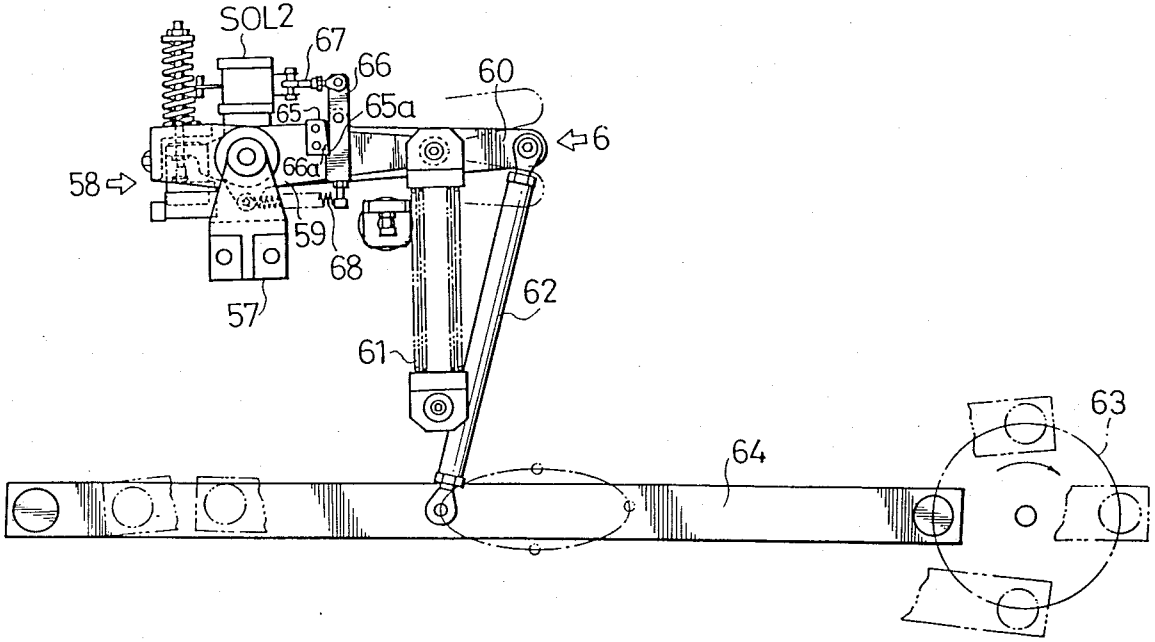
FIG. 6 is a front elevation of a sticher.

FIG. 6 illustrates the stitcher 6, which is constructed as follows.

Reference numeral 57 denotes a support member fixed to the machine frame (not shown). A lever 59 provided with a stitcher head 58 at one end thereof, and a lever 60 longer than the lever 59 are supported pivotably at their respective intermediate portions on the support member 57 so that these levers 59, 60 are positioned adjacently to each other and extend in the same direction. A spiral spring 61 is connected at its one end to the other end of the lever 59, which is provided with the stitcher head 58, and at the other end thereof to the machine frame. This spiral spring 61 imparts the return force to the lever 59. The other end portion of the elongated lever 60, i.e. the end portion of the lever 60 which is on the same side as the end portion of the lever 59 to which the spiral spring 61 is connected is joined pivotably to the upper end of a connecting rod 62. The lower end of this connecting rod 62 is joined pivotably to an intermediate portion of a crank lever 64, which is guided at one end thereof by a horizontal guide rail (not shown) provided on the machine frame (not shown), and supported pivotably at the other end thereof on an eccentric portion of a disc 63 rotating in the direction of an arrow. While this crank lever 64 is displaced as shown by the phantom lines, the lower end constituting a fulcrum of the connecting rod 62 is thereby moved along an elliptic path shown in the drawing. This movement of the connecting rod 62 is transmitted to the elongated lever 60 to turn the same as shown by the phantom lines.

A claw member 65 is attached to an intermediate portion of the lever 59 having the stitcher head 58, which claw member 65 is provided with a claw portion 65a directed toward the portion of the lever 59 to which the spiral spring 61 is connected. Reference numeral 66 denotes a vertical clutch lever supported pivotably at its intermediate portion on the upper side of the elongated lever 60. This clutch lever 66 extends in opposition to the claw portion 65*a* of the claw member 65, and is provided with a notch 65*a* with which the claw portion 65*a* is engaged. The upper end of the clutch lever 66 is connected to the end of an operating rod 67 of a solenoid SOL2 which is fixed to the portion of the elongated lever 60 which is near and on the upper side of a fulcrum section thereof. A spiral spring 68, which urges the clutch lever 66 toward the claw member 65, is provided between the lower end of the clutch lever 66 and the portion of the elongated lever 60 which is near and on the lower side of the fulcrum section thereof.

The solenoid SOL2 is excited when the limit switch LS2, the operation of which is timed with the contact of the limit switch LS1 in an ON-stage, is turned on. The operating rod 67 then draws the upper end of the clutch lever 66 toward the solenoid SOL2 against the resilient force of the spiral spring 68 to cause the notch 66*a* in the clutch lever 66 and the claw portion 65*a* of the claw member 65 provided on the lever 59 to disengage. Consequently, the elongated lever 60 turns irrespective of the lever 59.

Figure 7:
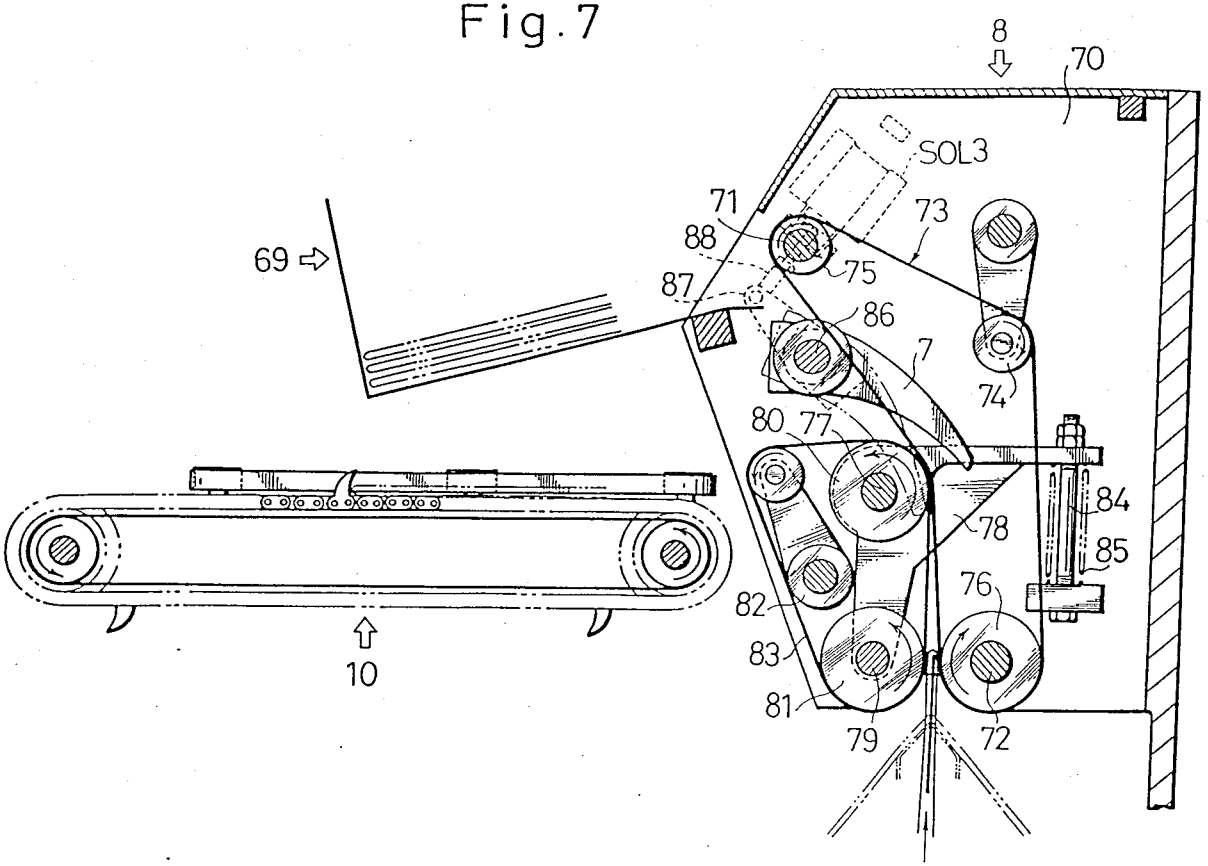
FIG. 7 is a partially-sectioned side elevation of a change-over means having a deflector lever.
Figure 8:
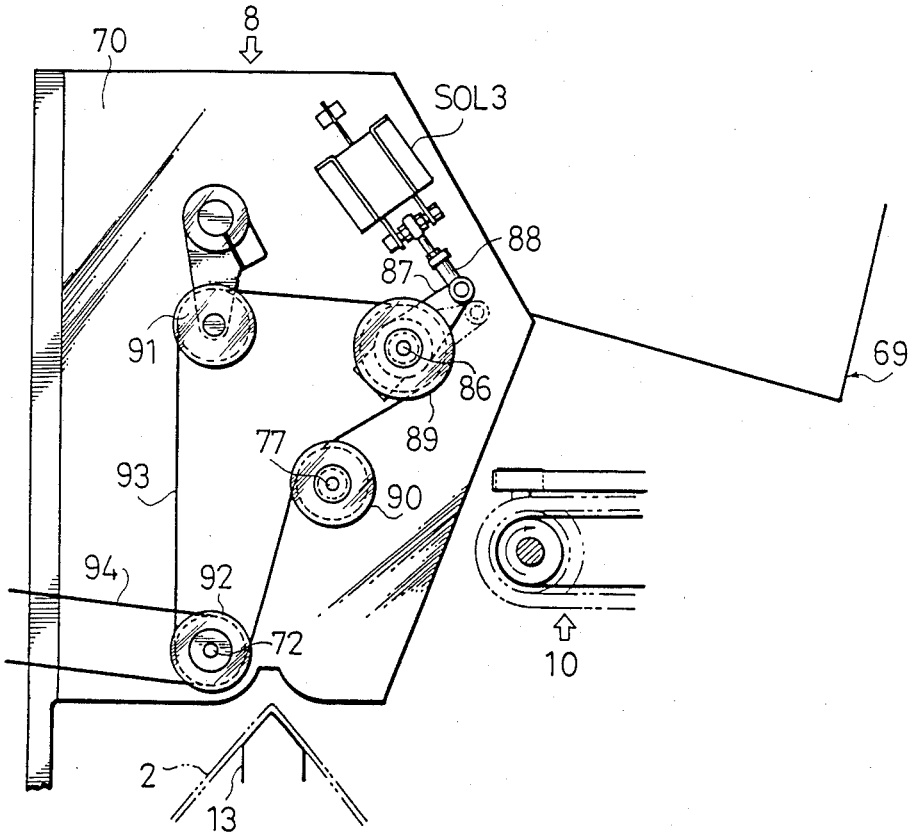
FIG. 8 is an opposite side elevation of what is shown in FIG. 7.
Figure 9:
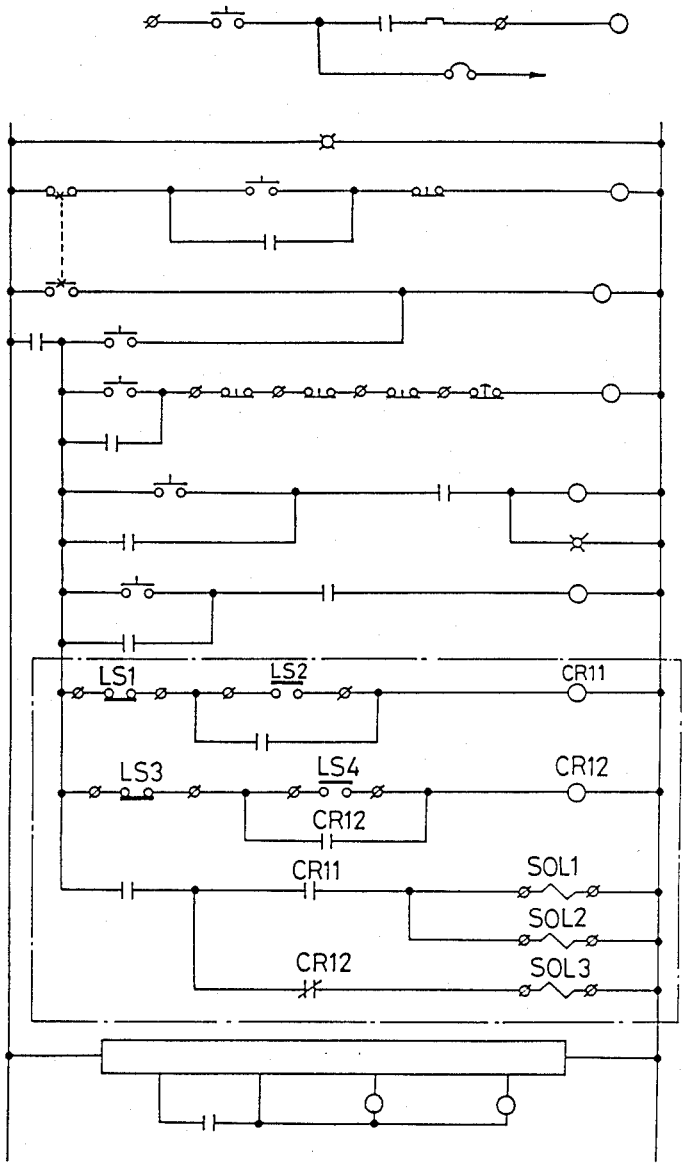
FIG. 9 is a circuit diagram.

FIGS. 7 and 8 show a change-over means 8 provided with the deflector lever 7, which is adapted to push up a stitched signature set and supply the same onto the transfer means 10 which is connected to the three-side trimming unit 9. The operations of this change-over means 8 include an operation for recovering a signature set, which has an abnormal thickness, and which has not yet been stitched, in an inferior signature set recovering unit 69.

The change-over means 8 will now be described.

Reference numeral 70 denotes a machine frame provided on the downstream side of the stitcher 6 in the saddle-wired preparing apparatus A. A plurality of belts 73 are wrapped around shafts 71, 72, which are supported rotatably on this machine frame 70, in such a manner that these belts 73 are spaced at suitable intervals. A tension roller 74 is disposed on the inner side of the belts 73 in a belt-pressing state so as to apply a suitable level of tensile force thereto. Pulleys 75, 76 are mounted on the shafts 71, 72 so that the pulleys 75, 76 are spaced at suitable intervals, on which pulleys 75, 76 the belts 73 are wrapped. Reference numeral 77 denotes a shaft supported rotatably on the machine frame 70, and hook-shaped levers 78 are supported pivotably at their respective bent corner portions on both ends of this shaft 77. A shaft 79 is provided between the lower ends of these hook-shaped levers 78. Pulleys 80, 81 are mounted on the shafts 77, 79 so that the pulleys 80, 81 are spaced at suitable intervals, i.e., on the portions of the same shafts which are opposed to the belts 73. Belts 83 are wrapped around these pulleys 80, 81 and tension rollers 82. The pulleys 81 provided at the lower ends of the hook-shaped levers 78 are opposed to the pulleys 76 at the lower portions of the belts 73.

The pulleys 80 provided at the bent corner portions of the hook-shaped levers 78 are positioned below the upper pulleys 75 around which the first-mentioned belts 73 are wrapped, i.e., between the upper pulleys 75 and the lower pulleys 76 so that the inner edges of the pulleys 80, which are provided rotatably at the bent corner portions of the hook-shaped levers 78, are on the inner side of a straight line connecting the upper and lower pulleys 75, 76. This enables the belts 83 to press-contact the intermediate portions of the belts 73, and the signature sets to be thereby transferred reliably. A spiral spring 85, through which a guide rod 84 is inserted, is provided between the lower side of an end portion of a horizontal part of each of the hook-shaped levers 78 so as to press the vertical belt portions, which extend between the pulleys 80, 81 provided at the upper and lower portions of the hook-shaped levers 78, against the belts 73.

Reference numeral 86 denotes a shaft provided between the upper shaft 71 around which the belts 73 are wrapped and the upper surfaces of the lower belts 83, and supported rotatably on the machine frame 70. One end of each deflector lever 7 is fixed to this shaft 86. The posture assumed by each deflector lever 7 introducing a normal signature set onto the transfer means 10 is as shown by a full line in FIG. 7, in which one end of the deflector lever 7 is fixed to the shaft 86 with the other end projecting into a space surrounded by the belts 73, an arcuate surface 7*a* formed on the lower side of the lever 7 being spaced at a suitable distance from the corresponding pulley 80 provided at the bent corner portion of the hook-shaped lever 78.

As shown in FIG. 8, a lever 87 is connected fixedly at its one end to the end portion, which projects to the outside of the machine frame 70, of the shaft 86 having the deflector lever 7 thereon. An operating rod 88 of a solenoid SOL3 attached the outer side surface of the machine frame 70 is connected to an effective end of this lever 87. This solenoid SOL3 is adapted to be excited after the B-contact of a relay CR12 has been turned on when the contact of the limit switch LS3 is turned off; the contact of the timing limit switch LS4 is turned on; and the contact of the relay CR12 is turned off, by the pins 41*a*, 41*b* which are operated in accordance with the excitation of the soelnoid SOL1. The excitation of this solenoid SOL3 causes the shaft 86 to be turned, so that the deflector lever 7 changes its posture to be displaced to the position shown in the phantom lines in FIG. 7. A signature set pushed up between the belts 73, 83 and transferred in a narrow space passes between an arcuate surface 7*b* formed on the rear side of the deflector lever 7 and the belt 73 to be introduced into the inferior signature set recovering unit 69.

Reference numeral 89 denotes a pulley mounted rotatably on the end of the shaft 86, 90 a pulley mounted fixedly on the end of the shaft 77 inserted through the bent corner portions of the hook-shaped levers 78, 91 a pulley mounted on the end of the shaft of the tension pulleys 74, and 92 a pulley mounted fixedly on the end of the shaft 72 provided on the lower portion of the machine frame 70, a belt 93 being wrapped around these pulleys 89, 90, 91, 92. A driving belt 94 is wrapped around a pulley (not shown) which is provided in opposition to the lower pulley. The power from this belt 94 is transmitted to the shafts 72, 77 via the pulleys 90, 92 to cause the belts 73, 83 to be driven at the same speed.

The operation of the present invention will now be described.

When a signature set (which will hereinafter be called normal signature set) having a predetermined thickness is held between the upper and lower sensor wheels 4, 5, the arm 17 moves up about the fulcrum shaft 16 by a distance corresponding to the thickness of the normal signature set. During this time, the lever 18 extending along the arm 17 is naturally urged upward but the locking member 18*a*, which is provided on this lever 18 is engaged with the free end of the thickness setting rod 26 which causes by its locking effect the same locking member 18*a* from being turned upward, so that the locking member 18*a* is urged downward relatively to the upward pivotal movement of the arm 17. Consequently, the end portion of the lever 18 turns upward, and the operating rod 19 provided at the end thereof engages with the dog 33 of the dog lever 32 as shown in FIG. 2. When the roller 36 provided on the lever 32*a*, which extends at right angles to the lower end portion of this dog lever 32 has dropped onto the flat cam surface 37*a* of the cam wheel 37, the dog lever 32 turns to left in FIG. 2 by the resilient force of the spiral spring 34 to cause the contact of the normally-closed limit switch LS1 to be opened by the knocker rod 35 provided at the upper end of the dog lever 32, and the normally-opened limit switch LS2 to be closed by the cam portion 51 provided on the cam wheel 50. As a result, current does not flow to the relay CR11, so that the solenoids SOL1, SOL2 are not excited. On the basis of this phenomenon, the thickness of the signature set is judged to be in a predetermined level, and this signature set is then stitched by the stitcher 6. The stitched signature set is fed to the transfer means 10 via the change-over means 8, and the upper, lower and fore marginal portions thereof are cut off by the three-side trimming unit 9. The resultant signature set is transferred from the stacker 12 to the table 11.

A case where the thickness of a signature set to be treated is larger or smaller than a predetermined thickness thereof will now be described. When the thickness of a signature set is larger than a predetermined thickness thereof, the free end of the operating rod 19 on the lever 18 engages with the notch 33*c* in the upper dog member 33*a* provided on the dog lever 32 as shown in the phantom lines in FIG. 4, so that the pivotal movement of the dog lever 32 is stopped. When the thickness of a signature set is smaller than a predetermined thickness thereof, the free end of the operating rod 19 engages with the notch 33*b* in the lower dog member 33*a* as shown by a solid line in FIG. 4, so that the pivotal movement of the dog lever 32 is stopped.

In such cases, the limit switch LS1 is not operated by the knocker rod 35, and, therefore, the contact of the limit switch LS1 is in an ON-state. When the contact of the limit switch LS2 is turned on by a cam portion 51 on the cam wheel 50, an electric current flows to the relay CR11, so that this relay is maintained in an ON-state with the solenoids SOL1, SOL2 excited at once. The excitation of the solenoid SOL1 causes the pin 41*a* or 41*b* in the operating wheel 40 to be pressed and projected therefrom toward the limit switch LS3. The contact of the limit switch LS3 is turned off by the pin 41*a* or 41*b*.

When the limit switch LS4 is turned on by the cam portion 54 of the cam wheel 53 synchronously with the opening of the limit switch LS3, the B-contact of the relay CR12 is kept in an ON-state, and the solenoid SOL3 is excited.

When the solenoid SOL2 is excited, the claw member 65 of the stitcher 6 and the clutch lever 66 are disengaged from each other to cut the connections of the lever 59 having the stitcher head 58 with the elongated lever 60 in operation. In consequence, an inferior signature set, which is transferred one cycle later, is not stitched. When the solenoid SOL3 is excited, the posture of the deflector levers 7 is changed as shown in the phantom lines in FIG. 7, and an inferior signature set pushed up between the belts 73, 83 and transferred is put into the recovery unit 69.

Figure 10:
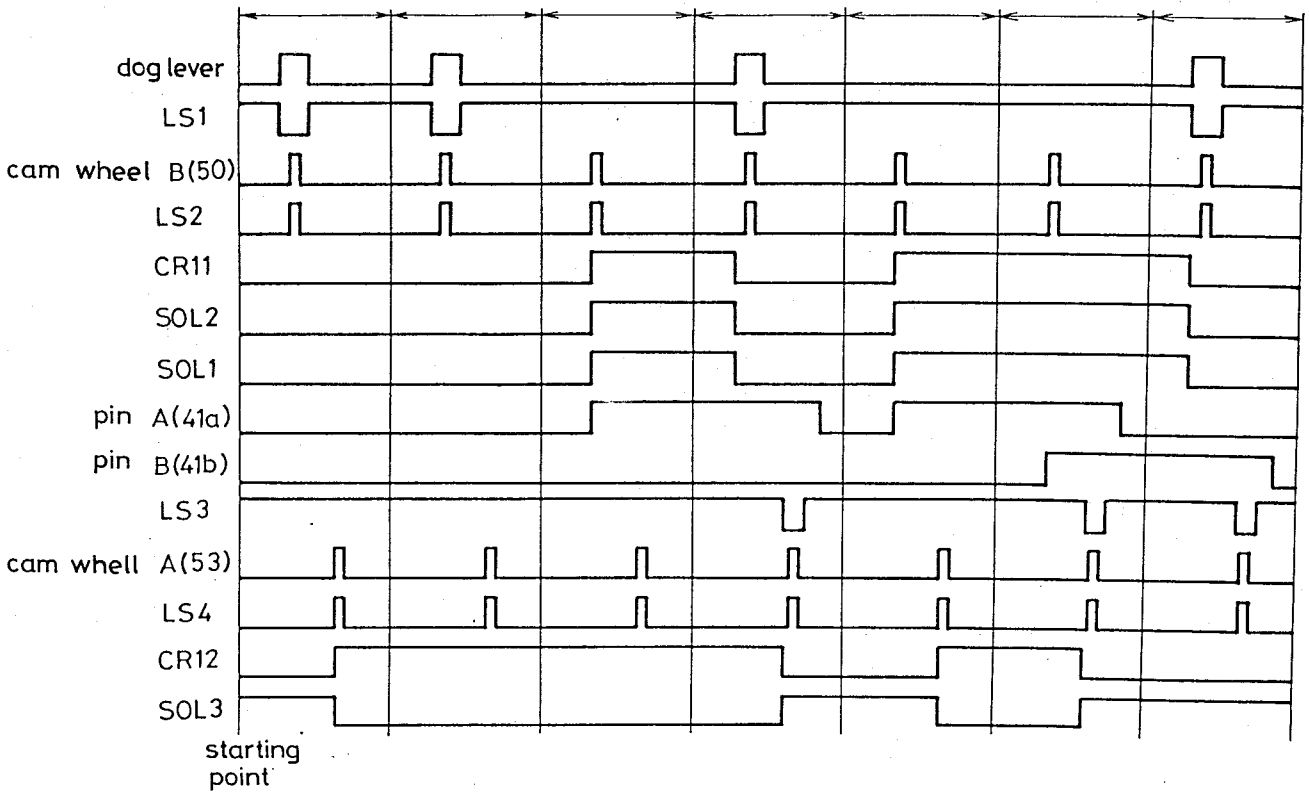
FIG. 10 is a time chart.

Referring to the time chart of FIG. 10, the upper sides of the lines representative of the operations of the contacts of the limit switches LS1, LS2, LS3, LS4 indicate that they are in an ON-state, and the lower sides thereof in an OFF-state. The upper sides of the lines representative of the operations of the solenoids SOL1, SOL2, SOL3 indicate that they are in operation, and the lower sides thereof not in operation. The upper sides of the lines representative of the operations of the pins A, B indicate that they project toward the limit switch LS3, and the lower sides thereof toward the solenoid SOL1. The upper sides of the lines representative of the operations of the contacts of the relays CR11, CR12 indicate that they are in an ON-state, and the lower sides thereof in an OFF-state. The limit switch LS3 is adapted so that the contact thereof is on when a signature set of a predetermined thickness is measured and when the measurement is not done, and so that this contact is turned off one cycle after the time of measurement when a signature set of an abnormal thickness other than a predetermined thickness is measured.

According to the thickness-discriminating mechanism of the present invention described above, in comparison with a conventional mechanism of this kind, the construction of the former can be simplified greatly, thereby reducing the chance for malfunctions. Especially, the present invention is constructed so that the electric operations of the limit switches, solenoids and relays are timed by mechanical means. Accordingly, the discrimination of a signature set of a normal thickness from a signature set of an abnormal thickness can be done reliably, and saddle-wired binding can be prepared with great efficiency.

The present invention is not, of course, limited to the above embodiments; it may be modified in various ways within the scope of the appended claims.

What is claimed is:

1. Signature thickness discriminating apparatus on a saddle-wired binding apparatus including a deflector means for guiding a signature set of normal thickness into a passage for a signature set of normal thickness, and for guiding a signature set of abnormal thickness into a passage for a signature set of abnormal thickness; and a stitcher for a signature set of normal thickness;

the signature thickness discriminating apparatus comprising:

a horizontally-extending arm supported pivotably at its base end on a machine frame, a larger-diameter sensor wheel provided rotatably at a free end of said arm;

a smaller-diameter sensor wheel supported rotatably on said machine frame in such a manner that the larger-diameter sensor wheel can contact the circumferential surface of said smaller-diameter sensor wheel from above;

a claw lever having a locking claw at the rear end thereof, extending along one side surface of said arm and supported pivotably at an intermediate portion thereof on said arm;

a power point working rod fixed to said machine frame so as to engage from above with the upper surface of the portion of said claw lever which is before said pivotably-supported portion thereof;

a dog lever having a dog supproted pivotably on said machine frame, impelled slidingly by a rotary cam and therefore moved pivotably, and positioned so that said dog lever cannot be turned when said locking claw engages with said dog, and can be turned when said locking claw is not in engagement therewith;

a starting switch means disposed in opposition to an upper end of said dog lever and adapted to be controlled in accordance with the pivotal movement of the upper end of said dog lever;

and solenoids connected to said deflector means and said stitcher and adapted to operate said deflector means and said stitcher in accordance with a control signal from said starting switch means.

2. Apparatus for discriminating signature sets of abnormal thickness from signature sets of normal thickness in a saddle-wired preparing apparatus having a transfer saddle to which cross-sectionally inverted-V-shaped signatures are supplied in a laminated state from a plurality of feeders, and gathering chains moving along said saddle and provided with pushers;

a thickness-detecting means to which signatures are transferred by pushers, and deflector levers adapted to guide signatures of a normal thickness and signatures of abnormal thickness which have passed through said detecting means into different passages, a stitcher in communication with said passage for signatures of normal thickness, and an abnormal signature-recovering unit in communication with said passage for signatures of abnormal thickness;

the thickness-detecting means including a horizontally-extending arm supported pivotably at its base end on a machine frame, a large diameter sensor wheel provided rotatably at a free end of said arm, a small diameter sensor wheel supported rotatably on said machine frame so that the large-diameter sensor wheel can contact the circumferential surface of said small-diameter sensor wheel slidingly from above;

a claw lever having a locking claw at the rear end thereof, extending along one side surface of said arm and supported pivotably at an intermediate portion thereof on said arm;

a power point working rod fixed to said machine frame to engage from above with the upper surface of the portion of the claw lever which is in front of said pivotably-supported portion thereof;

a dog lever having a dog, supported pivotably on said machine frame, urged slidingly by a rotary cam and moved pivotably, and positioned so that said dog lever cannot be turned when said locking claw engages with said dog, and can be turned when said locking claw is not in engagement therewith;

a starting switch means disposed in opposition to an upper end of the dog lever, the starting switch controlled by the pivotal movement of the upper end of the dog lever; and solenoids connected to the deflector means and stitcher, the solenoids controlled by a signal from the starting switch means to operate the deflector means.

* * * * *